US006280659B1

(12) United States Patent
Sundin

(10) Patent No.: US 6,280,659 B1
(45) **Date of Patent: *Aug. 28, 2001**

(54) VEGETABLE SEED OIL INSULATING FLUID

(76) Inventor: David W. Sundin, 923 Starlight St., Sherman, TX (US) 75090

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/810,314

(22) Filed: Feb. 28, 1997

Related U.S. Application Data

(60) Provisional application No. 60/012,595, filed on Mar. 1, 1996.

(51) Int. Cl.[7] ..... H01B 3/20

(52) U.S. Cl. ..... 252/578; 252/579; 252/570; 174/17 LF

(58) Field of Search ..... 252/578, 579, 252/570; 174/17 LF

(56) References Cited

U.S. PATENT DOCUMENTS

| | | | | |
|---|---|---|---|---|
| 4,618,914 | * | 10/1986 | Sato et al. | 361/315 |
| 4,627,192 | * | 12/1986 | Fick | 47/58 |
| 4,735,815 | * | 4/1988 | Taylor et al. | 426/417 |
| 5,260,077 | * | 11/1993 | Carrick et al. | 426/73 |
| 5,336,423 | * | 8/1994 | Pialet et al. | 252/76 |
| 5,413,725 | * | 5/1995 | Lal et al. | 252/18 |
| 5,429,761 | * | 7/1995 | Havelka et al. | 252/74 |
| 5,538,654 | * | 7/1996 | Lawate et al. | 508/308 |
| 5,766,517 | * | 6/1998 | Goedde et al. | 252/570 |
| 5,949,017 | * | 9/1999 | Oommen et al. | 174/17 LF |
| 5,958,851 | * | 9/1999 | Cannon et al. | 508/491 |

FOREIGN PATENT DOCUMENTS

| | | | |
|---|---|---|---|
| 0108571 | * | 5/1984 | (EP) . |
| 52-25298 | * | 2/1977 | (JP) . |
| 97/49100 | * | 12/1997 | (WO) . |
| 98/31021 | * | 7/1998 | (WO) . |

OTHER PUBLICATIONS

Surinder Parkash Seth, "Liquid Insulating Materials—A Survey", published in Electrical Engineering, India, Jun. 1972, pp. 5–9.

K.M. Kamath et al, "Variation of Dielectric Properties of Some Vegetable Oils in the Liquid–Solid Transition Phase", Indian Journal Technology, vol. 9, Aug. 1971, pp. 312–313.

H.C. Keshavamurthy et al, "Rape Seed Oil as a New Capacitor Impregnant", Central Power Research Institute, Bangalore, India, Presented at IEEE International Symposium on Electrical Insulation, Pittsburgh, Jun. 1994, pp. 418–421.

H.C. Keshavamurthy et al, "Rape Seed Oil Derivative as a New Capacitor Impregnant," Central Power Research Institute, Bangalore, India, presented at IEEE International Symposium or Electrical Insulation, Pittsburgh, Jun. 1994.

T.S. Ramu, "On the High Frequency Behavior of Castor Oil," Indian Institute of Science, published in IEEE Transactions in Electrical Insulation, Jun. 1979.

* cited by examiner

*Primary Examiner*—Yogendra N. Gupta
*Assistant Examiner*—Derrick G. Hamlin
(74) *Attorney, Agent, or Firm*—Andrus, Sceales, Starke & Sawall, LLP

(57) ABSTRACT

A unique, fire resistant, environmentally safe insulating oil comprised of selected vegetable oils, fortified with additives to improve stability and low temperature viscosity characteristics. The electrical equipment comprises an oil-sealed tank, the insulating oil filling the tank, and electrical components such as a transformer, switch, or fuse immersed in the described oil. Also contemplated is a solid-liquid insulation system comprising porous insulating materials saturated with vegetable seed oil.

8 Claims, No Drawings

VEGETABLE SEED OIL INSULATING FLUID

CROSS-REFERENCE TO RELATED APPLICATIONS

This application claims priority to Provisional Application Ser. No. 60/012,595 filed on Mar. 1, 1996.

STATEMENT REGARDING FEDERALLY SPONSORED RESEARCH OR DEVELOPMENT

N/A

BACKGROUND OF THE INVENTION

Internal parts of electrical power transformers and switchgear are normally immersed in an electrical insulating fluid. The electrical insulating fluid performs several functions and has specific requirements. It acts as an insulating medium between energized parts of the electrical equipment. It cools equipment by transferring heat from the windings and core of a transformer to a cooling surface. It quenches an arc created in the operation of switchgear or a fuse.

In case of accidental spills, the fluid should not be hazardous to animal or plant life. It should be biodegradable, meaning that microbes present in soil and water should be able to break down the chemical compounds of the fluid over time to substances that are less toxic, non-toxic, or inert. The fluid should be chemically stable during the useful life of the electrical equipment. It should exhibit low flammability, in case of a fire involving the electrical equipment.

Liquid insulating or dielectric fluids in electrical transformers and switchgear are well known in the art. See for example, U.S. Pat. Nos. 3,000,807; 3,095,366; 3,587,168; and 3,753,188. These patents describe the use of insulating fluids in equipment and the types of fluids so used. The most commonly used fluids have been petroleum oils, silicone fluids, or synthetic, hydrocarbon fluids. However, each of these materials has certain drawbacks, particularly with respect to environmental impact and biodegradability.

Silicone fluid, for example has been used widely as a fire-resistant insulating oil, but has been shown not to biodegrade to any appreciable extent. In addition, silicone fluid polymerizes when exposed to an electric arc, forming silicone gel particles that later interfere with the dielectric or insulating function of the fluid.

Petroleum fluids work well in most applications, but, depending on their chemistry, biodegrade very slowly. Spills of petroleum fluids have damaged soil and water ecosystems and can persist in the environment for years.

Petroleum, silicone, and synthetic hydrocarbon fluids thus perform well as insulating oils, but do not address the ever-increasing demands that fluids be more easily biodegraded and less harmful to the environment when spilled onto soil or water.

Due to lack of standardization of test methods and agreement on desired characteristics by industry, many levels of biodegradation exist. Petroleum products, for example, have been shown to biodegrade to a certain extent, if the proper conditions and species of bacteria are available in soil or water.

Because of their molecular structure, vegetable seed oils can be shown to biodegrade much more rapidly and completely than the above described electrical insulating fluids.

Vegetable seed oils have been tried as insulating oils in the past, but their use has been hindered by their poor stability. Vegetable seed oils age and become unstable at a much faster rate than petroleum or silicone products, especially at the elevated temperatures and in the presence of metal, typically found in electrical transformers.

BRIEF SUMMARY OF THE INVENTION

The present invention relates to an improved vegetable seed oil based electrical insulating fluid that is stable in use, relatively nonflammable, rapidly and highly biodegradable, environmentally safe, and competitively inexpensive.

The present invention also relates to improved methods for manufacturing electrical insulation fluids of this type.

The fluid of the present invention preferably comprises highly saturated vegetable seed oils obtained from various sources including genetically improved species of plants. Vegetable seed oils can be used "as is" if they are naturally highly saturated. On the other hand, if the oil is highly unsaturated, it may still be used as an insulating oil if it is first processed by hydrogenation or other means to increase the degree of saturation and thus the degree of oleic acid concentration to improve stability. Such oils may be used either alone or as blends of oils, and may advantageously further include appropriate chemical additives that enhance the oxidation and chemical stability of the seed oils, improve low temperature viscosity and flow characteristics, and act as metal scavengers.

More specifically, the improved electrical insulating fluid of the present invention may preferably comprise vegetable seed oils or blends of vegetable seed oils found to have greater stability than previously used oils or combinations of oils. Such oils and/or blends, when processed in accordance with the methods of the present invention and fortified with additives described herein, form an electrical insulating fluid that meets all functional standards set forth in ASTM D3487 for conventional transformer oil.

The present invention also relates to the use of the improved insulating fluids in equipment, and to equipment containing such fluids.

Various other features, objects, and advantages of the invention will be made apparent from the following detailed. description and the drawings.

DETAILED DESCRIPTION OF THE INVENTION

The following examples are representative of the types of vegetable seed oils that can be used to manufacture an insulating or dielectric fluid that exhibits chemical, oxidative, and hydrolytic stabilities: sunflower seed oil, canola or rapeseed oil, castor oil, meadowform seed oil, and jojoba oil. Each of these oils has sufficient saturation to function as an insulating oil.

Experimentation has shown that seed oils that exhibit enhanced anti-oxidant effect perform better as insulating fluids. Thus, other vegetable seed oils, which initially are highly unsaturated and are therefore normally undesirable for use as insulating fluids, may also be used as insulating fluids if their stability and resistance to oxidation are enhanced by genetic means or by chemical processing of the oils. These other vegetable seed oils may include, for example, corn oil, olive oil, peanut oil, sesame oil, coconut oil, and soybean oil.

These other oils listed can be used as insulating oils if they are stabilized with respect to oxidation. The measure of oleic acid concentration is a measure of the number of saturation of double bonds in the oil's molecules. Processing by hydrogenation or other means to increase the degree of saturation will improve the stability of any of these oils whether they were initially of the high oleic acid variety or not. The other oils listed will make insulating oils that are functional, but not optimum, because of poorer stability when compared to the oils that are stabilized through genetic means (cultured to have high oleic acid contents) or chemo/mechanically, or both.

Good predictors of oxidation stability in oils include a naturally high oleic acid content in seed oils (oleic acid is saturated, and therefore more stable than other, nonsaturated acids that could be present). High oleic acid contents are indicated by the following test results:

Iodine Number, AOCS Cd 1–25:<86

Peroxide Value, AOCS Cd 8.53 1.0

Another way to achieve a high degree of saturation is through hydrogenation in a processing plant.

Tests for oxidation stability: ASTM D2440, ASTM D2112.

Essentially, the seed oils are blends of paraffinic or iso-paraffinic molecules of 16 to 20 carbons that contain one or more double bonds (i.e. unsaturated bonds). These bonds are weak points in the molecular structure and are the first sites of oxidative degradation. 16–20 carbon atoms give the oil a molecular weight and structure that provides the optimum tradeoff between flammability characteristics (vapor pressure) and viscosity. An oil having a carbon atom chain that strays too far above or below this range results in an oil too volatile or too viscous for use as an insulating fluid. Therefore, molecules with the lowest number of double bonds are desired. Vegetable oil with 16 carbon atoms and only one double bond is particularly desirable. This particular molecule is called oleic acid. Preferred oils are those having enhanced oleic acid concentrations due to genetic screening and selective breeding or by chemical or mechanical means.

The vegetable seed oils can be blended with themselves or with other oils for use in electrical apparatus. These other fluids may be added to improve stability or oxidation resistance, to lower the cost of the resulting blend, or to improve the functional characteristics of the vegetable seed oil. These oils may be those refined from natural petroleum oils, or may be themselves synthetic hydrocarbons such as poly-alpha olefins, organic or inorganic esters, or alkyl silicone compounds. There are other fluids that are compatible with vegetable see oils and impart enhanced stability. These blends with other fluids are also intended to be covered under this patent.

Vegetable seed oil blends that have been found to be useful as electrical insulating or dielectric fluids are as follows:

Blend 1

78% by volume High Oleic Acid Sunflower See Oil, Lubrizol 7631 brand

22% by volume High Oleic Acid Rapeseed (canola) oil, Lubrizol 7633 brand

Blend 2

40% by volume High Oleic Acid Sunflower Seed Oil, Lubrizol 7632 brand

80% by volume FloraEster Jojoba oil, manufactured by International Flora Technologies Blend 3

65% by volume High Oleic Acid Sunflower Seed Oil, Lubrizol 7632 brand

30% by volume High Oleic Acid Rapeseed (canola) oil, Canola Industries Canada brand 5% by volume FloraEster Jojoba oil, manufactured by International Flora Technologies A preferred blend of vegetable seed oils is as follows:

Blend 4

90% by volume High Oleic Acid Sunflower Seed Oil, Lubrizol 7632 brand

10% by volume FloraEster Jojoba oil, manufactured by International Flora Technologies These vegetable seed oil blends exhibit the following characteristics when processed in the manner described herein:

| Characteristic and ASTM test method: | Blends 1 | 2 | 3 | 4 |
|---|---|---|---|---|
| Fire Point, D92, ° C. | 341 | 335 | 345 | 350 |
| Pour Point, D97, ° C. | −21 | −5 | −18 | −18 |
| Viscosity @ 40° C., D445, cSt. | 37 | 24.2 | 39.3 | 31.6 |
| Dielectric Strength, D877, kV | 44 | 46 | 35 | 38 |
| Dissipation Factor @ 25° C., D924, % | 0.08 | 0.05 | 0.04 | 0.05 |

The vegetable seed oils should preferably have an iodines value of less than or equal to 86, preferably less than or equal to 82. The free fatty acid content of the oil should be less than 0.05%.

In general, the base seed oil blend used in the present invention should preferably have the following characteristics:

| Characteristic and Test Method: | Test Value |
|---|---|
| Physical Tests: | |
| Fire Point, D92, ° C., minimum: | 300 |
| Viscosity, D445, cSt. at 40° C., maximum: | 100 |
| Viscosity, D445, cSt. at 100° C., maximum: | 13 |
| Pour Point, D97, ° C., maximum: | −18 |
| Moisture Content, D1533b, ppm, maximum: | 200 |
| Chemical Tests: | |
| Acid Value, D664, mg KOH/g, maximum: | 0.05 |
| Iodine Value, AOCS Cd 125, maximum: | 86 |
| Free Fatty Acids, AOCS CA5a40, %, maximum: | 0.05 |
| Stability Tests: | |
| Oxidative Stability, D2272, minutes, minimum: | 20 |
| Thermal Stability, Cincinnati Milacron test: | |
| Copper Appearance | 1 |
| Iron Appearance | 1 |
| Sludge, mg/100 ml | 3 |
| Copper Corrosion test, D130: | 2a |
| Biodegradability, %, CEC-L33A94: | >97 |

The finished dielectric fluid made from the above-mentioned seed oil blends, when processed and fortified in accordance with the present invention, should have the following characteristics:

| Characteristic and Test Method: | Test Value |
|---|---|
| Physical Tests: | |
| Fire Point, D92, ° C., minimum: | 300 |
| Viscosity, D445, cSt. at 40° C., maximum: | 100 |
| Viscosity, D445, cSt. at 100° C., maximum: | 13 |
| Pour Point, D97, ° C., maximum: | −18 |
| Moisture Content, D1533b, ppm, maximum: | 200 |

-continued

| Characteristic and Test Method: | Test Value |
|---|---|
| Chemical Tests: | |
| Acid Value, D664, mg KOH/g, maximum: | 0.05 |
| Electrical Tests: | |
| Dielectric Strength, D1816-0.08" gap, kV, mimimum: | 56 |
| Dissipation Factor, D974, % at 100C., minimum: | 0.30 |
| Stability Tests: | |
| Oxidative Stability, D2272, minutes, minimum: | 20 |
| Thermal Stability, Cincinnati Milacron test: | |
| Copper Appearance | 1 |
| Iron Appearance | 1 |
| Sludge, mg/100 ml | 3 |
| Copper Corrosion test, D130: | 2a |
| Biodegradability, %, CEC-L33A94: | >97 |

The processing method used to purify the vegetable seed oil blend is as follows: The oil is heated to 80–100 C., then introduced to a mixture of activated adsorbent clay and activated alumina. This adsorptive filtration process removes polar contaminants and free fatty acids from the oil. These materials have deleterious effects upon the oil's color, electrical properties and stability in use. A preferred composition of the adsorbent mixture is 60% activated clay and 40% activated alumina. However, any adsorbent material may be used to clean impurities from the oils so long as it is substantially compatible with the oil and it does not substantially adversely affect the insulating characteristics of the oil. An example of an optimum mixture would be 60% Filtrol 20 activated clay with 40% A2 activated alumina from Kaiser Chemical Co. The activated clay is efficient in removing simple polar molecules, while the alumina is more effective in removing free fatty acids, a more complex molecule. The described mixture of adsorbents has been found to result in a more stable oil with better electrical characteristics than either adsorbent used alone and the mixture of activated clay and activated alumina adsorbents has been found to be optimum in the removal of polar material from the oil.

Non-activated clay ("Fuller's Earth") may be used, but will not produce an oil product with as high electrical dielectric strength. A particularly desirable clay is LVM 30/60 Fuller's Earth available from Engelhard Minerals. Microfiltration technology could also be used to remove polar contaminants.

Polar contaminants removed in processing are of two primary types, water and those chemicals that occur naturally in the oil that give oil a darker color and poorer electrical characteristics. Naturally occurring chemicals are ionic materials such as metal soaps of Mg, Ca, Cl, etc. They may also be sulfonates, resins, or partially oxidized molecules. Trace metals are also preferably removed. Peroxides, ketones, and other oxidation byproducts are also preferably removed.

The vegetable seed oil may be introduced to the mixed adsorbent material by several methods; percolation, forced pressure flow through canister filters filled with adsorbent, or by mixing the adsorbent into the oil for a specified period of time and then removing it with plate and frame filters (the "slurry" method). Of these, the slurry method has been found to work the best, as it offers the most complete contact between the active sites on the adsorbent particles and the oil.

The preferred embodiment of this invention comprises heating the vegetable seed oil to 90° C., mixing it with one pound of adsorbent mixture per gallon of oil for 70 minutes with continuous mechanical mixing, then removing the adsorbent with plate and frame filters. Processing the vegetable seed oil in this way removes a large amount of polar contaminating material possible. Further processing yields limited additional removal of polar materials.

After the adsorbent filtration step, the purified oils have had the vast majority of polar contaminants removed, but they still contain small particles of clay and dissolved moisture and gases. These contaminants will lower the dielectric strength of the oil. To remove the particulate contamination, the fluid is passed through a particulate filter, with a nominal pore size of less than five microns. This type of filter will remove the majority of clay particles from the oil. The oil is then passed through a degassifier whereby dissolved moisture and gases are removed. The degassifier acts by exposing a very thin layer of the oil to a high vacuum, allowing the dissolved moisture and gases to boil away from the oil. The thin film can be achieved in various ways; the most common being a fine spray of the fluid into an evacuated chamber. This process removes nearly all dissolved moisture and gases from the oil.

The oil is then blended with appropriate additives that will enhance the oxidation stability of the oil, causing it to have a longer service life. Various types of oxidation inhibitors can be used. It has been found preferable to use oxidation inhibitors in combination with metal passivators since the combination has been found to work better than either compound alone. Additive concentration may be between 0–3% by weight, but is preferably between 0.2–0.3% by weight.

The additives are called "hindered phenols" and act by trapping free radicals in the oil solution which are both a by-product and an initiator of oil oxidation. The free radical trap mechanism sacrificially oxidizes the inhibitor, rather than the vegetable oil. The preferred hindered phenols are butylated hydroxy toluene [BHT] and di-tert-butyl para cresol [DBPC]. Particularly preferred is 4,4 methylenebis (2,6, di-tert-butyl-phenol) available from Ethyl Chemical Co. as Ethanox 702.

Another type of oxidation inhibitor is the so-called "amine" chemicals. One example is Additin RC 7001A, from Rhein-Chemie Corporation, which provides excellent oxidation stability at treatment levels of 0.6–0.8%. Other examples are phenyl napthylamine (trade name Additin RC 7130), and stearinated diphenylamine (Additin RC 7135 from RheinChemie Corporation). These inhibitors can be used together in combination with one another or separately.

Metal passivators, as used here, are compounds that coat metal surfaces to prevent ion migration into the oil. These compounds often contain mercaptans, or sulfur-containing chemicals. RheinChemie's Additin RC 8210, which is mercaptothiadiazole, when added to oil at 0.05% by weight, provides excellent protection against oil dissolution. Benzotriazole and tolyltriazole, available from Bayer Chemical as Preventol C18 and C17, respectively, may also be used. Other possible antioxidants are propyl gallate and TBHQ—tertiary butyl hydroquinone.

Oxidation inhibitors developed for use with petroleum fluids do not give the same results when used with vegetable seed oils. The most common antioxidant compounds used with petroleum, DBP (di-tert butyl phenol) and DBPC (di-tert butyl para-cresol) do not produce the same level of oxidation inhibition activity when used with vegetable seed oils at the same concentration as they are used in petroleum.

A unique combination of antioxidants and metal passivators that adds the necessary oxidation inhibition effect to enable the use of vegetable oil blends as commercially viable dielectric oils is comprised of the following:

0.4% by weight dimeric hindered phenol antioxidant (trade name RheinChemie RC7115)

0.01% by weight benzotriazole, a metal scavenger that removes copper ions from the oil solution 0.005% by weight of RheinChemie RC4801, a mixture of amine-type antioxidants The percentages by weight are based on the weight of the vegetable oil blend.

Dissolved metal ions in the oil, particularly copper and iron, can act as catalysts in the oil oxidation reaction. Although they are not directly used up in the reaction, the metals provide a pathway for the oxidation reaction to proceed. By incorporating a chelating agent to "tie up" the metals in solution it is possible to remove this pathway and significantly slow the kinetics of the oxidation reaction. When chelating agents are used along with sacrificial inhibitors described above they act in an interactive manner, each multiplying the effectiveness of the other. The preferred chelating agent is benzotriazole (BTA) at 20–100 ppm concentrations.

This additive combination has proven itself to be highly effective at inhibiting both the onset of oxidation (called the "oxidation induction time", or "OIT") as well as retarding the acid formation and molecular polymerization that occurs when oxidation has begun. OIT is measured with a test called ASTM D2112, the Rotating Bomb Oxidation Test, in which an oil sample is subjected to high heat, copper ions (which catalyze the oxidation process) and high pressure oxygen. The oil pressure in the test cell is measured over time to determine when the oil begins to react with the oxygen, indicating the onset of the oxidation reaction. The processed vegetable seed oil blend of the present invention has been found to resist the initiation of the oxidation reaction for more than 400 minutes. The standard value in this test for conventional transformer oil is 195 minutes.

The formation of acids and sludge during the ageing process is measured by ASTM Test Method D2440, in which oxygen is bubbled at a standard rate through a test tube of oil, held at 1100° C. A piece of copper wire is immersed in the test sample, to provide copper ions, which will speed the oxidation reaction. The test oil is subjected to these conditions for 72 hours and also for 164 hours. Samples are removed at the end of these periods and tested for acidity and sludge content. For oxidation inhibited conventional transformer oil in this test, the results should fall within the following limits:

| | Acid Value, mg KOH/g | Sludge, wt %: |
|---|---|---|
| 72 hours | 0.3 | 0.1 |
| 164 hours | 0.4 | 0.2 |

The above described vegetable oil blend, having been treated in the manner described above and fortified with the disclosed additives, exhibits the following results in accelerated oxidation tests:

| ASTM D2440: | Acid Value, mg KOH/g | Sludge, wt %: |
|---|---|---|
| 72 hours | 0.06 | 0.03 |
| 164 hours | 0.15 | 0.05 |

An added feature of the vegetable seed oil based blend of the present invention is that it is resistant to ignition by electric arc or flame. The U.S. National Electric Code recognizes the benefit of fire resistance by creating a classification of insulating oils called "less-flammable". This classification requires that an insulating oil have a fire point, as measured by ASTM D92, of greater than 300° C. As noted above, the vegetable seed oil blends of the present invention have fire points in excess of 300° C. As a comparison, conventional transformer oil has an ASTM D92 firepoint of about 150° C. The use has of less flammable fluids been recognized as a reduction in the risk of fire and explosion since the late 1970s.

While the present invention has been described above in connection with applications such as transformer and switchgear, it will be appreciated that the invention is not so limited and that the invention will find use in other applications, such as capacitors or voltage regulators, or more generally as a heat transfer fluid.

The actual insulating medium of a transformer and a capacitor is made of porous paper that is saturated with the insulating oil. The transformer windings are insulated from one another by kraft paper or a newer material called "Nomex" which is manufactured by DuPont. The oil saturates the paper (or Nomex) and it is the oil-paper combination that actually acts as an electrical insulator between the energized windings of the transformer.

It is recognized that other equivalents, alternatives, and modifications aside from those expressly stated, are possible and within the scope of the appended claims.

What is claimed is:

1. A method for manufacturing a vegetable seed oil based electrical insulating fluid comprising the steps of:

providing a vegetable seed oil or blend of vegetable seed oils containing oleic acid and consisting essentially of a vegetable seed oil or a blend of vegetable seed oils having an iodine number of less than or equal to 86;

heating the vegetable seed oil or blend of vegetable seed oils to a temperature of between about 80° C. to about 100° C.;

purifying the heated vegetable seed oil or blend of vegetable seed oils to remove substantially all polar contaminants, free fatty acids, and particulate materials therefrom to produce a purified vegetable seed oil, wherein the step of purifying the oil comprises mixing the oil with a blend of activated clay and activated alumina, and thereafter separating the oil from the blend of clay and alumina by passing the oil through a filter;

degassifying the purified vegetable seed oil or blend of vegetable seed oils to remove moisture and gases therefrom, said degassifying step reduces the moisture content of said oil to less than or equal to 200 ppm; and stabilizing the vegetable seed oil or blend of vegetable seed oils to inhibit oxidation thereof, wherein the step of stabilizing includes mixing an oxidation inhibitor with said oil.

2. The method according to claim 1 wherein the vegetable seed oil is selected from the group consisting of sunflower seed oil, rapeseed oil, meadowform seed oil, and jojoba oil.

3. The method according to claim 1 wherein the vegetable seed oil is highly unsaturated oil selected from the group consisting of corn oil, olive oil, peanut oil, sesame oil, coconut oil, and soybean oil, and further including the step of increasing the degree of saturation of said highly unsaturated oil to enhance stability and resistance to oxidation.

4. The method according to claim 3 wherein the step of increasing the degree of saturation comprises hydrogenating said highly unsaturated oil.

5. The method according to claim 1 wherein the iodine number is less than or equal to 82.

6. The method according to claim 1 wherein the blend of activated clay and activated alumina comprises about 10–90% activated clay and about 10–90% activated alumina.

7. The method according to claim 1 further including the step of adding a metal passivator to said oil.

8. The method according to claim 1 further including the step of adding a chelating agent to said oil.

* * * * *